US007896708B2

(12) United States Patent
Agevik

(10) Patent No.: US 7,896,708 B2
(45) Date of Patent: Mar. 1, 2011

(54) CONNECTOR SYSTEM WITH ELECTRICAL CONNECTION AND INFRARED COUPLING AND METHOD

(75) Inventor: Markus Agevik, Malmo (SE)

(73) Assignee: Sony Ericsson Mobile Communications AB, Lund (SE)

( * ) Notice: Subject to any disclaimer, the term of this patent is extended or adjusted under 35 U.S.C. 154(b) by 677 days.

(21) Appl. No.: 11/928,245

(22) Filed: Oct. 30, 2007

(65) Prior Publication Data

US 2009/0110404 A1 Apr. 30, 2009

(51) Int. Cl.
*H01R 13/10* (2006.01)

(52) U.S. Cl. ..... 439/669; 439/18; 439/20; 439/21; 439/22; 439/23; 439/24; 439/217; 439/607.04; 439/607.35; 439/607.17; 439/607.11; 439/607.26; 439/607.02; 439/607.19; 455/151.2; 385/105; D13/133; 342/53

(58) Field of Classification Search ..... 439/18, 439/20, 21, 22, 23, 24, 217; 385/105
See application file for complete search history.

(56) References Cited

U.S. PATENT DOCUMENTS

| | | | | |
|---|---|---|---|---|
| 4,537,453 | A * | 8/1985 | Takeuchi | 439/217 |
| 6,876,838 | B1 * | 4/2005 | Daly et al. | 455/90.3 |
| 2002/0160656 | A1 * | 10/2002 | Nishita | 439/577 |
| 2003/0016920 | A1 * | 1/2003 | Sohmura et al. | 385/88 |
| 2004/0043668 | A1 * | 3/2004 | Ikuta | 439/668 |
| 2004/0157499 | A1 * | 8/2004 | Nania et al. | 439/680 |
| 2005/0026560 | A1 * | 2/2005 | Villaverde et al. | 455/3.06 |
| 2005/0124220 | A1 * | 6/2005 | Wang | 439/607 |
| 2006/0116084 | A1 * | 6/2006 | Miki et al. | 455/90.3 |
| 2007/0003192 | A1 * | 1/2007 | Wang et al. | 385/75 |
| 2007/0141869 | A1 | 6/2007 | McNeely et al. | |

FOREIGN PATENT DOCUMENTS

| | | |
|---|---|---|
| DE | 94 21 727 U 1 | 6/1996 |
| EP | 1 690 517 A2 | 8/2006 |

OTHER PUBLICATIONS

International Preliminary Report on Patentability from corresponding International Application No. PCT/IB2008/000687 mailed Feb. 18, 2010.
International Search Report, corresponding to PCT/IB2008/000687, mailed Sep. 25, 2008.
Written Opinion of the International Searching Authority, corresponding to PCT/IB2008/000687, mailed Sep. 25, 2008.

* cited by examiner

*Primary Examiner*—Pierre-Louis Desir
(74) *Attorney, Agent, or Firm*—Renner, Otto, Boisselle & Sklar, LLP

(57) ABSTRACT

An electrical connector system provides both electrically conductive connection and infrared coupling, and includes at least one electrically conductive member adapted to provide electrically conductive connection to another electrically conductive member, an infrared member adapted to provide infrared member coupling with another infrared member, and wherein the at least one electrically conductive member and the infrared member being held in positional relation to each other to be positioned with respect to a further electrical connector for electrically conductive connection and infrared coupling with respect thereto. A method of connecting electrical signals uses a pair of electrical connectors, each having an electrically conductive connection portion and an infrared coupling portion to provide for both electrically conductive connection and infrared coupling between the electrical connectors. The invention may be used in portable electronic equipment, including mobile phones, for example.

18 Claims, 9 Drawing Sheets

CONNECTOR SYSTEM WITH ELECTRICAL CONNECTION AND INFRARED COUPLING AND METHOD

TECHNICAL FIELD

The present invention relates generally, as indicated, to connector system with electrical connection and infrared coupling and method, and to electronic equipment using both electrically conductive signal connections and infrared signal coupling and method; and, more particularly, to a connector plug and socket system for portable electronic equipment, for example, a mobile phone, capable of providing electrical conductive connection of signals and also infrared coupling of signals and method.

BACKGROUND

Mobile and/or wireless electronic devices are becoming increasingly popular. For example, mobile telephones, portable media players and portable gaming devices are now in wide-spread use. In addition, the features and accessories associated with certain types of electronic devices have become increasingly diverse. To name a few examples, many electronic devices have cameras, text messaging capability, Internet browsing capability, electronic mail capability, video playback capability, audio playback capability, image display capability and handsfree headset interfaces. Exemplary accessories may also include headphones, music and video input players, etc.

Many mobile and/or wireless electronic devices include audio connectors and/or other connectors to which accessories, such as, for example, handsfree headsets, headphones, external speakers, and devices associated with the above and other capabilities and functions, etc., may be connected. Audio connectors and other type of connectors for such devices usually include one or more pins, contacts, terminals or terminal portions of respective wires or of printed circuit traces, and the like via which electrical signals and/or power are conducted between a connector of the mobile phone, for example, and the connector of the accessory, for example, or of another device (collectively referred to as accessories below). Sometimes it would be desirable to conduct more signals and/or to provide greater bandwidth for coupling between such electronic devices and accessories than was heretofore possible using standard electrical connectors.

As an example, some audio connectors of portable electronic devices have used five pins or five electrical paths for connection with corresponding pins or electrical paths of the accessory connector of an accessory, and a substantial amount of data, signals, etc. may be transferred via connectors and such connection paths. However, if the number of conductive paths, e.g., the number of pins and/or electrically conductive traces, wires, terminals, etc., were reduced, for example, to reduce size or for some other reason, the amount of data, signals, etc. that could be transferred between the electronic device and accessory may be reduced. For example, a new electrical connector, sometimes referred to as a 3.5 millimeter connector, may have four electrically conductive paths rather than five paths that have been available in other connectors that have been used for similar purposes, e.g., audio signal connection, etc. Further, if one or more conductive paths in a connector system were used for coupling power or to identify an accessory to an electronic device, the number of signal carrying conductive paths (sometimes referred to as channels) may be reduced compared to the number of available signal channels when coupling is between self-powered devices.

SUMMARY

Briefly, in accordance with one aspect of the present invention an infrared connection (also referred to as coupling) is provided in conjunction with an electrical connector that provides electrically conductive connection for an electronic device.

The aforesaid connection system that provides both coupling of signals between one device, e.g., an electronic device, such as a portable electronic device, for example, a mobile phone, and another device, such as, for example, an accessory for the one device, may provide an increase in the number of channels for signals to be exchanged, transmitted or the like between the one device and the another device.

In accordance with another aspect, a method includes transferring signals between an electronic device and an accessory via one or more electrically conductive paths and additionally transferring signals using infrared coupling, which may be separate from the one or more electrically conductive paths.

According to an aspect of the invention, a connector for use in providing both electrically conductive connection and infrared connection, includes at least one electrically conductive member adapted to provide electrically conductive connection to a further electrically conductive member, an infrared member adapted for use in infrared coupling with a further infrared member, and the at least one electrically conductive member and the infrared member being held in positional relation to each other to be positioned with respect to a further connector for electrically conductive connection and infrared coupling with respect thereto.

Another aspect relates to including the further connector, the further connector including at least a one further electrically conductive member adapted to connect by electrical conduction with the at least one electrically conductive member, and a further infrared member adapted to connect by infrared coupling to the infrared member.

Another aspect relates to a connector system wherein one of the infrared member and further infrared member comprises an infrared source and the other of the infrared member and further infrared member comprises an infrared sensor, the infrared source and infrared sensor adapted to transmit and to receive, respectively, signals therebetween.

Another aspect relates to the at least one electrically conductive member comprising a male plug having at least one electrical terminal and a support structure adapted to support the electrical terminal, and wherein the infrared member comprises at least one of an infrared source or infrared sensor that is supported at least in proximity to the at least one electrical terminal.

Another aspect relates to wherein the at least one electrical terminal extends generally linearly along an axis from the support structure and the infrared source or infrared sensor is supported in relation to the at least one electrical terminal in at least partial circumscribing relation about such axis.

Another aspect relates to wherein the infrared member is in the at least one electrical terminal of the male plug.

Another aspect relates to wherein the infrared member is at or in proximity to the leading tip of the at least one electrical terminal of the male plug.

Another aspect relates to further comprising a housing, an opening in the housing, the at least one electrically conductive member in the opening in position to provide electrically conductive connection to a further electrically conductive member that may be inserted in the opening, and wherein the infrared member is supported with respect to the opening for optical coupling with a further infrared member when such another electrically conductive member is inserted in the opening.

Another aspect relates to wherein the infrared member is within the housing accessible to the interior of the opening and adapted at least one of to send infrared light into or to receive infrared light from within the opening.

Another aspect relates to wherein the infrared member is mounted outside the housing and opening.

Another aspect relates to wherein the infrared member comprises a plurality of infrared members.

Another aspect relates to wherein the at least one electrically conductive member comprises an audio connector, and the infrared member is attached to the audio connector for support thereby.

Another aspect relates to the connector system included in a mobile phone.

Another aspect relates to wherein the further connector comprises a housing, an opening in the housing and adapted to receive at least part of the at least one electrically conductive member inserted in the opening for electrically conductive connection between the at least one electrically conductive member and the further electrically conductive member, and wherein the infrared member and the further infrared member are positioned in relation to the respective at least one electrically conductive member and the further electrically conductive member to be in optically coupled relation when the at least one electrically conductive member is in the opening in electrically conductive connection with the further electrically conductive member.

Another aspect relates to the infrared member comprising a plurality of infrared members, said further infrared member comprising a plurality of infrared members, said infrared members and further infrared members being respectively supported for paired alignment to provide communication between respective pairs of infrared sources and infrared sensors, and further comprising an alignment guide adapted to guide connection of the connector and further connector to provide paired alignment of respective pairs of infrared sources and infrared sensors to obtain respective separate communication channels between respective pairs of infrared source and infrared sensor.

Another aspect relates to wherein with the electrical connector and further electrical connector connected, the infrared member and further infrared member are positioned in close proximity and cooperative relation to block leakage of infrared energy away from the connected connector and further connector.

Another aspect relates to a portable electronic device including the connector system and housing, the further connector comprising an audio connector for the portable electronic device, and the connector comprising an audio plug adapted for coupling to an accessory of the portable electronic device.

Another aspect relates to such portable electronic device being a mobile phone.

Another aspect relates to a method of connecting electrical signals, comprising using a pair of electrical connectors, each having an electrically conductive connection portion and an infrared connection portion, one of the infrared connection portions including an infrared energy source and the other infrared connection portion comprising an infrared energy detector, providing both electrically conductive connection between respective electrically conductive connection portions and infrared energy coupling between respective infrared energy source and infrared energy detector, thereby to provide transfer of signals between the connectors via electrical connection channel and an infrared energy coupling channel.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "comprises/comprising" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments.

Moreover, in the drawings, like reference numerals designate corresponding parts throughout the several views and may be used to designate like or similar parts in more than one embodiment. Also, primed reference numerals, e.g., 1', 1", 1''', etc., may be used to designate parts that are similar to parts designated by the same unprimed reference numeral.

In the description below reference to FIG. 1 collectively refers to both FIGS. 1A and 1B, and reference to FIG. 2 collectively refers to all of FIGS. 2A-2D.

DESCRIPTION

The interchangeable terms "electronic equipment" and "electronic device" include portable radio communication equipment. The term "portable radio communication equipment," which hereinafter may be referred to as a "mobile radio terminal," as "portable electronic equipment," or as a "portable communication device," includes all equipment such as mobile telephones, pagers, communicators, electronic organizers, personal digital assistants (PDAs), smartphones, portable communication apparatus or the like.

In the present application, embodiments of the invention are described primarily in the context of a mobile telephone. However, it will be appreciated that the invention is not intended to be limited to the context of a mobile telephone and may relate to any type of appropriate electronic equipment, examples of which include a media player, a gaming device, PDA and a computer, etc.

As is described in greater detail below, infrared signal coupling is used to provide at least one additional channel or data transfer or signal coupling path for a connector system 1, which also has at least one electrically conductive connection.

Figure 2A:
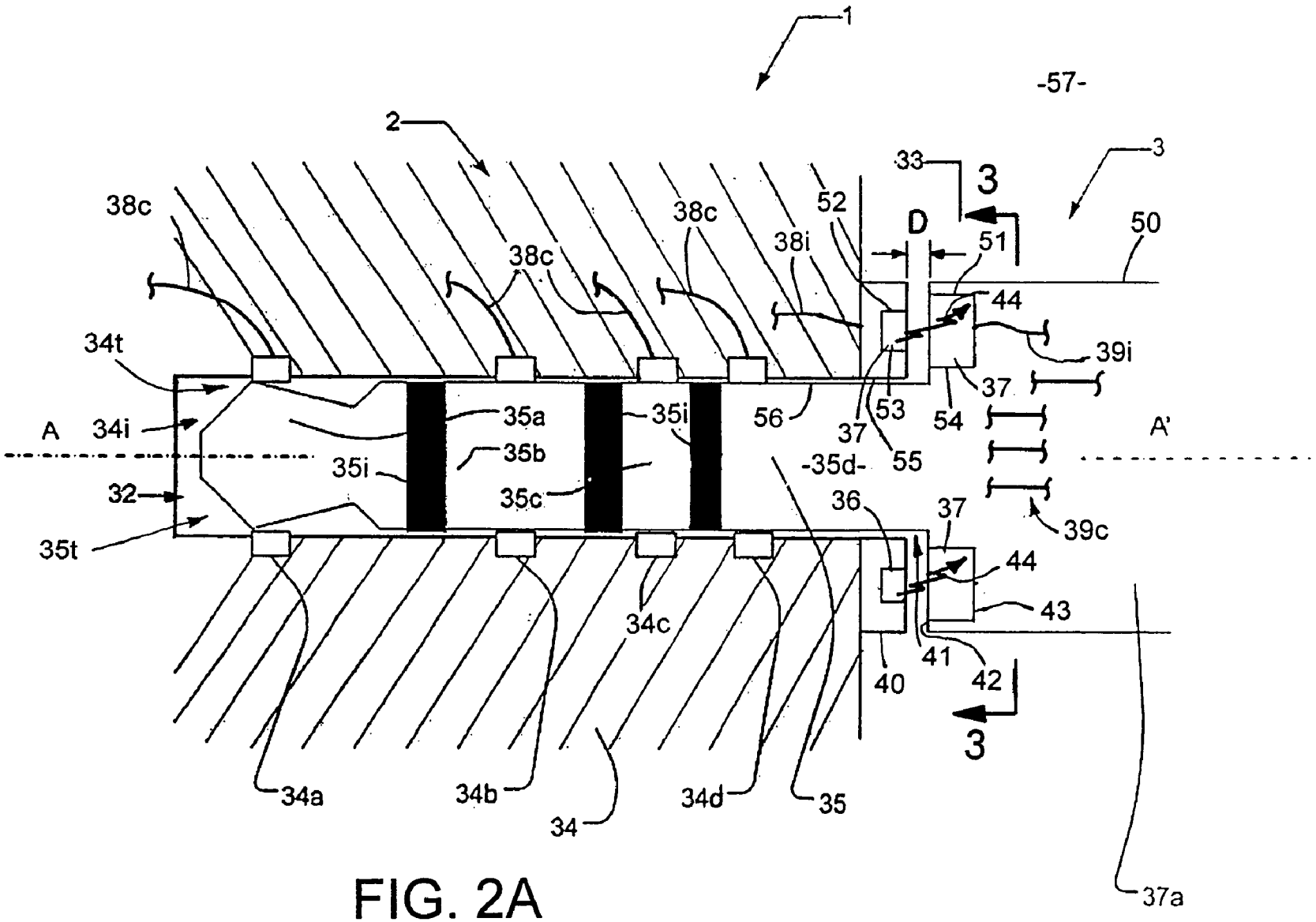
FIG. 2A is a schematic illustration of a connector system according to an embodiment of the invention.
Figure 2B:
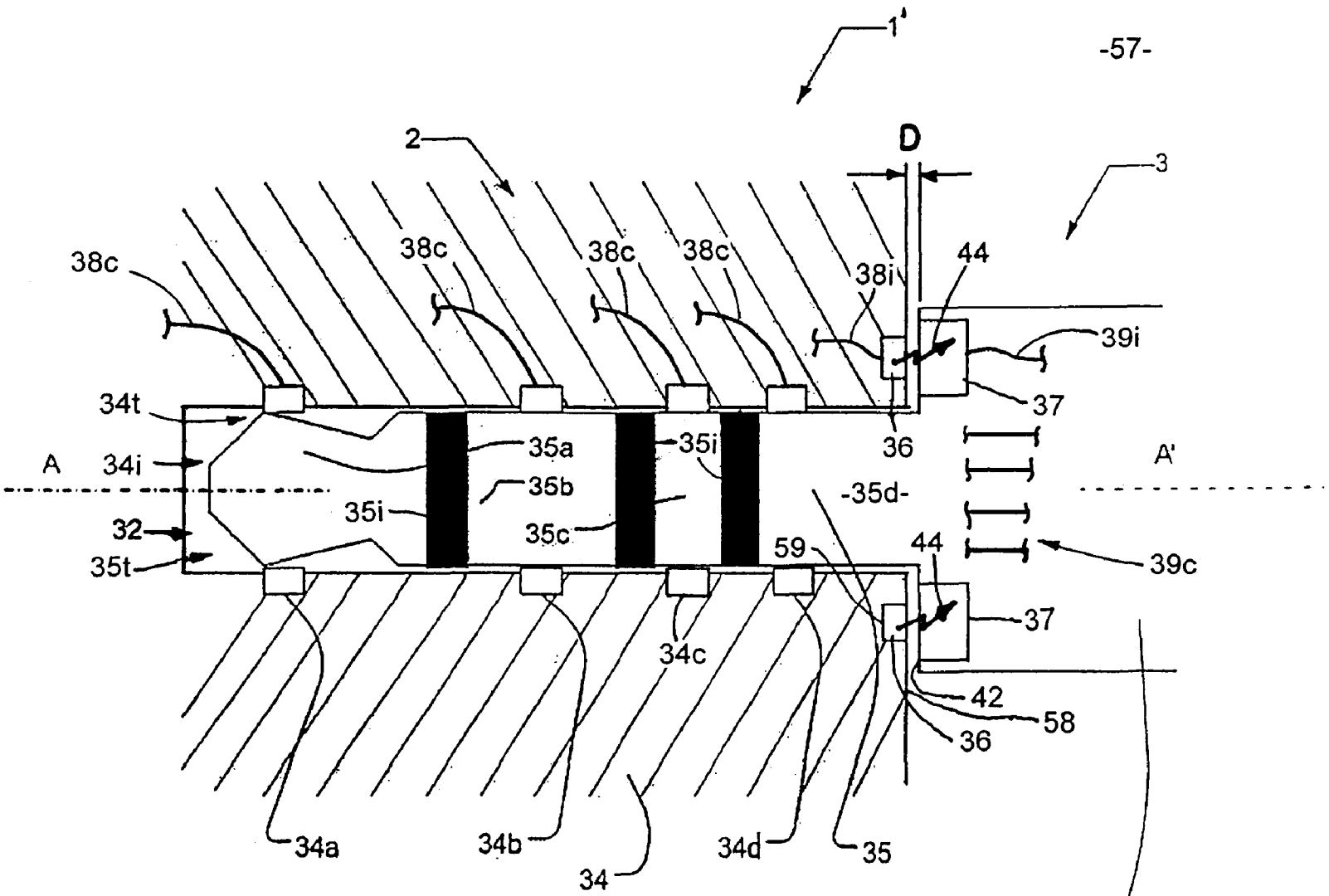
FIG. 2B is a schematic illustration of a connector system according to another embodiment.
Figure 2C:
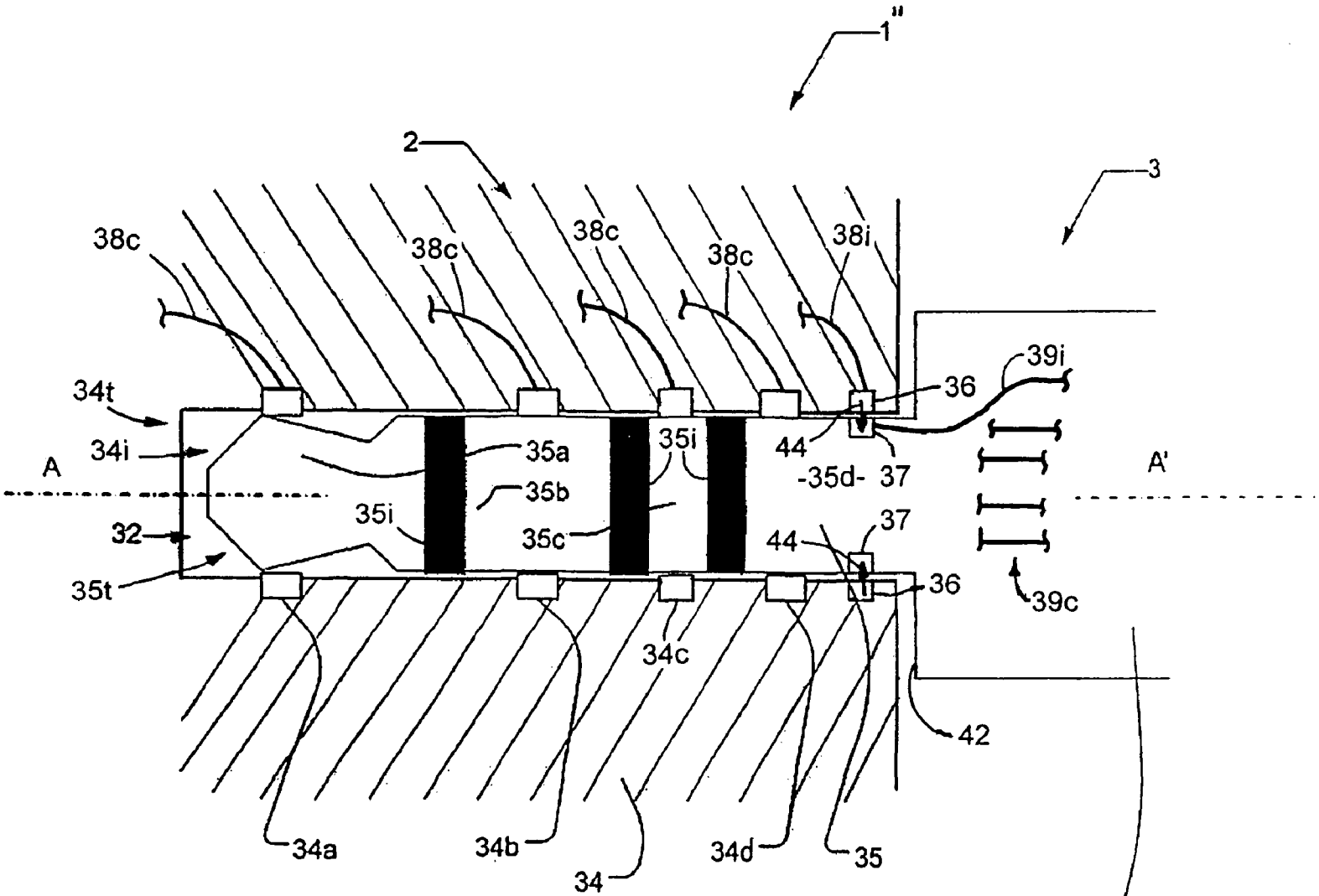
FIG. 2C is a schematic illustration of a connector system according to another embodiment.
Figure 2D:
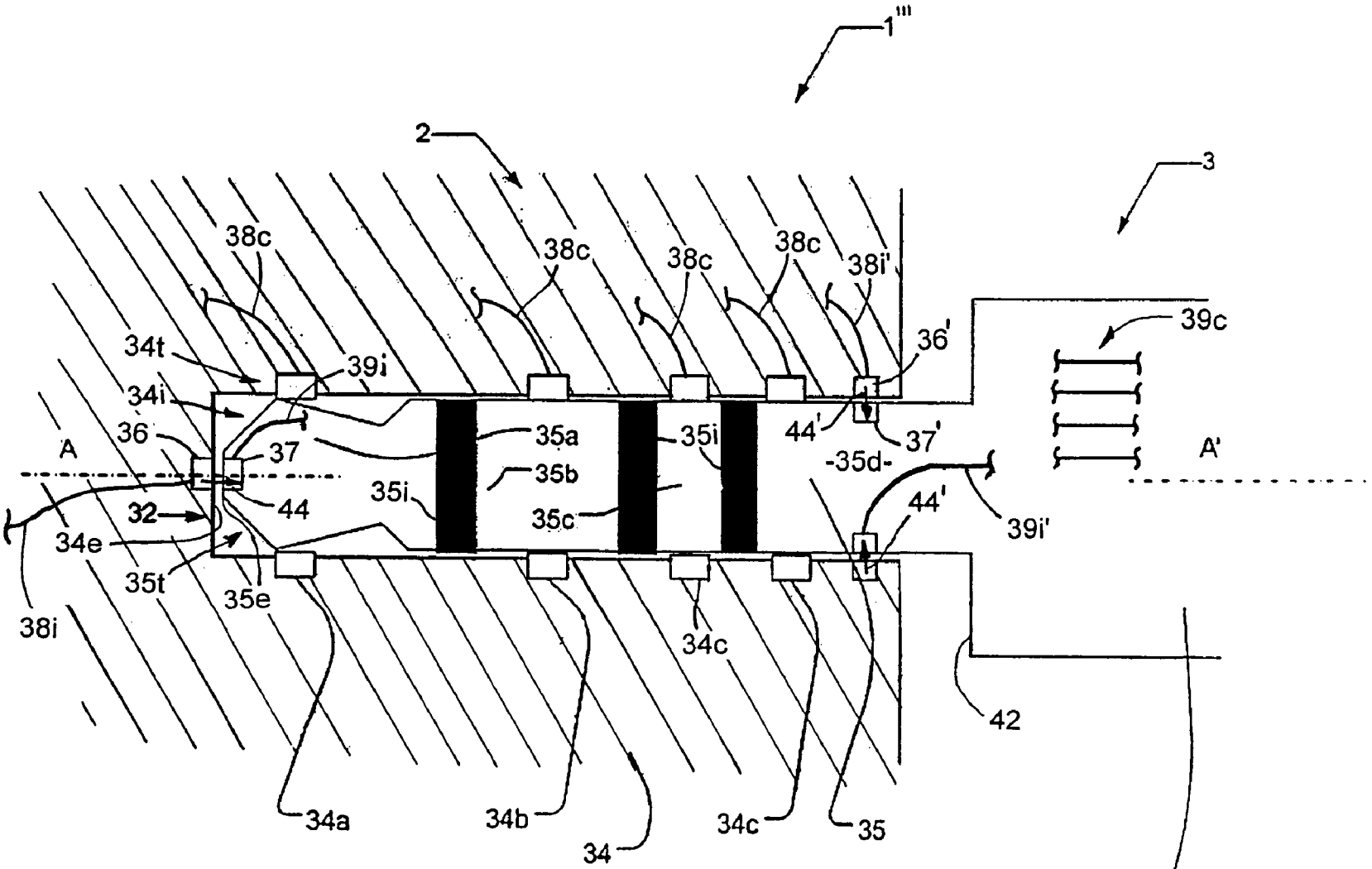
FIG. 2D is a schematic illustration of a connector system according to another embodiment.
Figure 3:
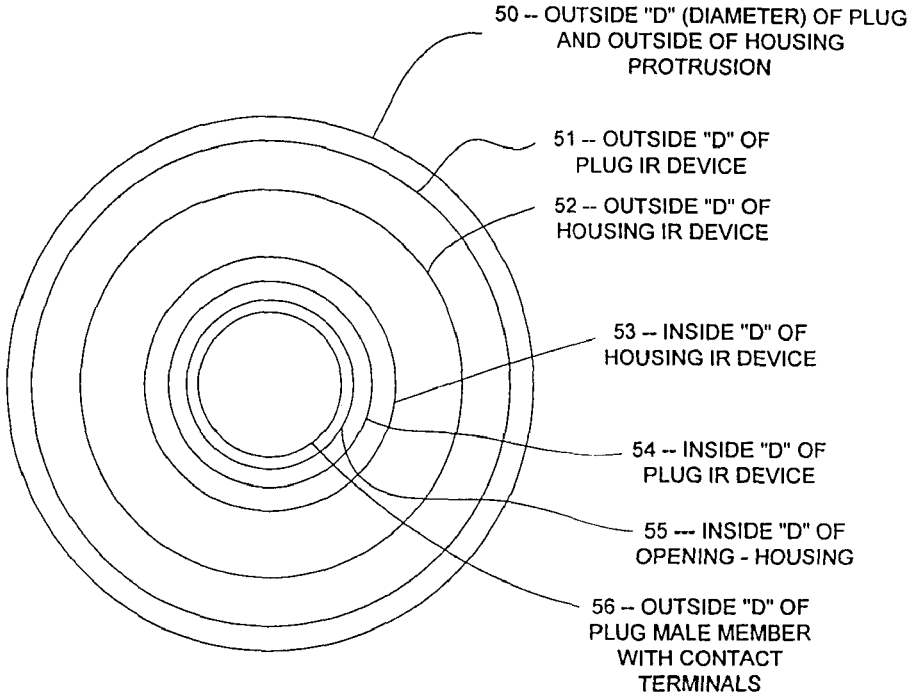
FIG. 3 is a schematic view of the connector system of FIG. 2A looking in the direction of the arrows 3-3.

In FIGS. 1-3, a connector system 1, for example, includes two connectors (also referred to as connector parts), 2, 3 that may be connected together to provide both electrically conductive connection of respective electrically conductive contacts, pins, terminals or the like and also infrared coupling or connection, for example, using respective infrared light (also referred to as infrared energy). Thus, electrical connection of signals or data, for example, between the two parts 2, 3 of the electrical connector system 1 is provided by electrical conduction and by infrared coupling. The term infrared may be used as a shorthand to refer to infrared energy, infrared light, electromagnetic energy that is in the wavelength band or region associated with infrared wavelengths generally without regard to where located in the infrared wavelength band, e.g., near, far or otherwise. Infrared energy and infrared light may be used interchangeably and equivalently. Infrared source and infrared emitter may be used equivalently to refer to a device that provides infrared energy output, e.g., in response to an electrical input. Infrared sensor, infrared detector, and infrared receiver may be used equivalently to refer to a device that responds to infrared energy to provide a given output in response thereto, e.g., an electrical output.

The infrared coupling provided by the connector system 1 may be used to add one or more additional channel(s), communication path(s), data connection(s), etc., between a mobile phone 10 and an accessory, etc., as is described in further detail below. Such connection may be relatively secure by avoiding widespread distribution of the infrared signal(s), e.g., using "line of sight" connection from an infrared source or emitter to an infrared detector. Also, the connector part 2, for example, as associated with a mobile phone 10 or other electronic device, may be backwards compatible such that it may be used to provide electrically conductive connections with a standard audio plug or the like (or some other plug) that does not have infrared coupling functions or capability, as will be evident from the description below.

Figure 1A:
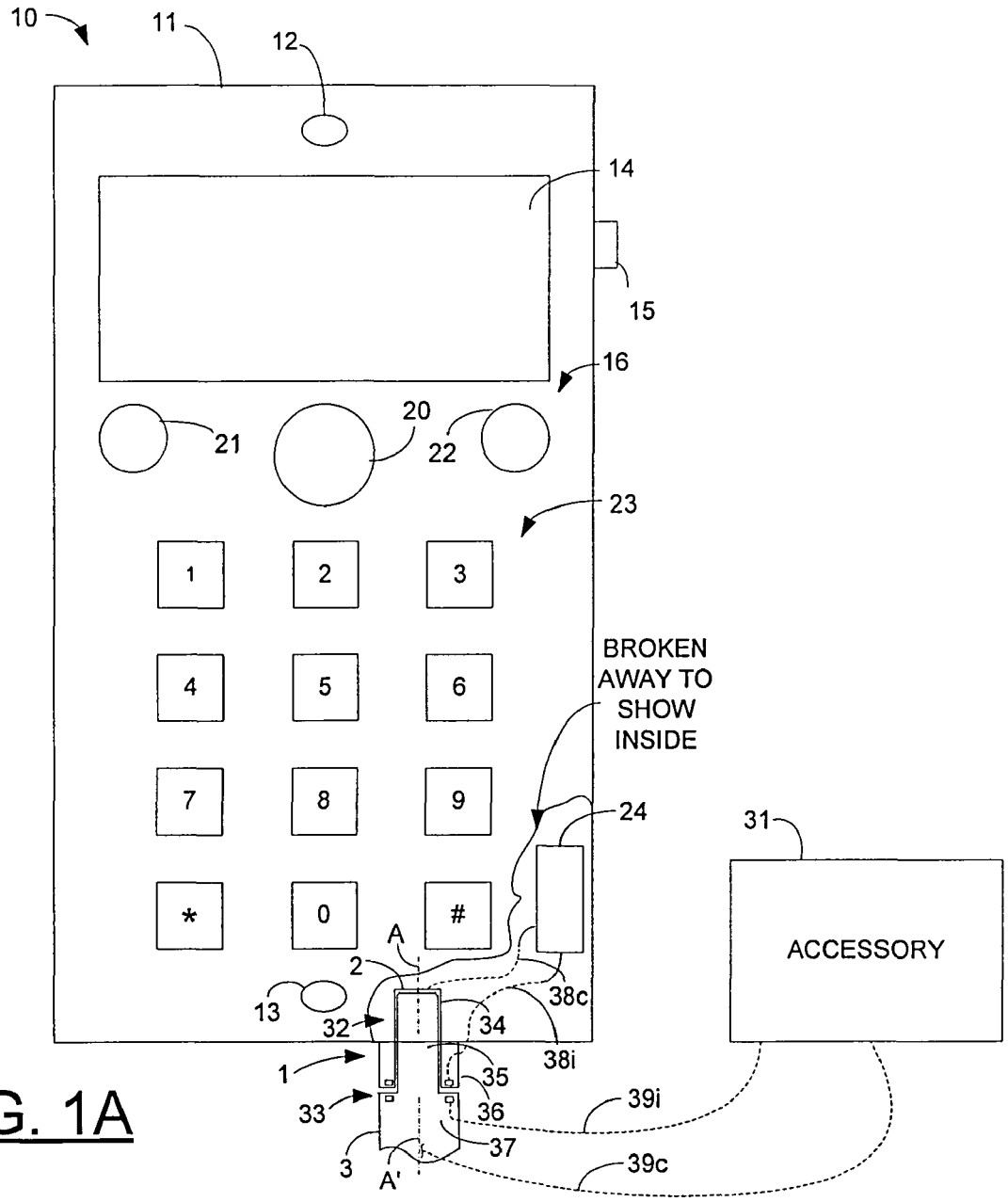
FIG. 1A is a schematic illustration of the front of a portable communication device, e.g., in the form of a mobile phone, using a connector system with electrically conductive and infrared coupling capability according to an embodiment of the present invention.
Figure 1B:
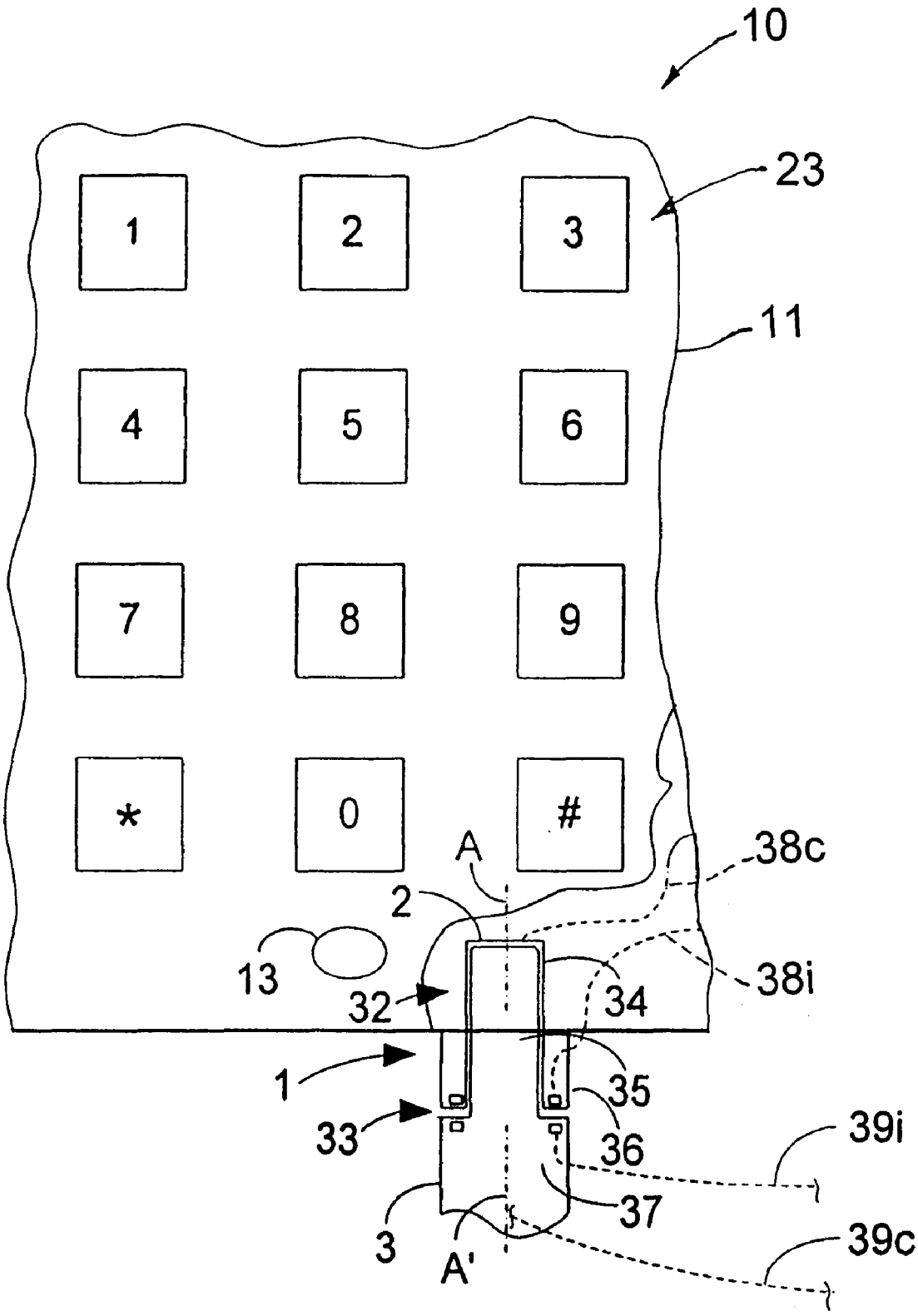
FIG. 1B is an enlarged fragmentary view similar to FIG. 1A.

Referring in further detail to FIGS. 1 and 2 (including FIGS. 1A, 1B, and 2A through 2D), the connection system 1 used with regard to a portable communication device 10 is illustrated in respective embodiments of the present invention. The portable communication device 10 will be referred to below as a mobile phone. However, as was mentioned above, reference to "mobile phone" includes various other electronic equipment or devices, such as, for example, those mentioned above. In outward appearance, for example, as is illustrated in FIG. 1, the mobile phone is of one type of design or style; however, the features of the invention, as are described in further detail below, may be used in other types of mobile phones, such as those that include cases that open and close (sometimes referred to as a "flip phone," "slidable case phone," etc.), and various other mobile phones that currently exist or may come into existence in the future.

In several embodiments of the invention described in detail below, one of the connector parts 2 is an audio connector of mobile phone 10 and the other connector part 3 is an audio plug that in turn may be connected to an earphone speaker, to headphones, to external stereo speakers, to other types of accessories or devices, etc. (collectively referred to below as accessories for brevity) that may be used with the mobile phone. Electrical signals may be coupled by the connector system 10 between the mobile phone and one or more accessories; power connection also may be provided between the mobile phone and accessories. The electrical signals also may be coupled between the electrical connector system parts 2, 3 using infrared coupling techniques. For example, at one of the mobile phone 10 or the accessory, an electrical signal may drive an infrared light source causing it to provide an infrared light output, which is representative of such electrical signal; and that infrared light output may be coupled to and sensed or detected by an infrared light detector at the other of the accessory or mobile phone. Although one use of the invention is with an audio connector system, the invention may be used in other connector systems.

As is seen in FIG. 1, the mobile phone 10 includes case (housing) 11, speaker 12, microphone 13, display 14, e.g., liquid crystal display, light emitting diode display, or other display, on/off switch 15, and a number of keys generally indicated at 16. The keys 16 may include a number of keys having different respective functions. For example, the key 20 may be a navigation key, selection key or some other type of key; the keys 21, 22 may be, for example, one or more soft switches or soft keys (two examples are shown); and the keys 23 may be dialing keys. As an example, the navigation key 20 may be used to scroll through lists shown on the display 14, to select one or more items shown in a list on the display to move a cursor shown on the display, etc. The soft switches 21, 22 may be manually operated to carry out respective functions for which the key is designated by prior setting of the mobile phone, for example, or functions such as those shown or listed on the display 14 in proximity to the respective soft switch or selected by the navigation key 20, etc. The dialing keys 23 may be used to dial a telephone number or to input alphanumeric or other data and the dialed number may be called by pressing a send key or one of the soft switches 21, 22. The speaker 12, microphone 13, display 14, and keys 16 may be used and function in the usual ways in which a mobile phone typically is used, e.g. to initiate, to receive and/or to answer telephone calls, to send and to receive text messages, to connect with and to carry out various functions via a network, such as the Internet or some other network, to beam information between mobile phones, etc. These are examples; there may be other uses that currently exist or may exist in the future. The mobile phone 10 also includes operating circuitry 24 that responds to programming and to inputs, e.g., provided by a user pressing a key or applying a stylus or finger to a touch-sensitive screen, etc., or provided from an external source, such as an incoming telephone call or text message, to carry out functions of the mobile phone. As is seen in FIG. 1, part of the housing of the mobile phone is broken away to show an interior portion of the housing, including the operating circuitry 24 and the electrical connector system 1.

The electrical connector system 1 connects the mobile phone 10, e.g., the operating circuitry 24 thereof, with another device, e.g. an accessory 31, a remote device, etc. Such electrical connector system 1 provides for both electrically conductive connection by an electrically conductive portion 32 and infrared coupling by an infrared coupling portion 33. The connector system 1 may be in the general form of an audio connector including both a female housing (sometimes referred to as a receptacle or as an opening) 34 and a male plug 35 that is intended to plug into the female housing.

As is seen in FIGS. 1 and 2, the female housing 34 and male plug 35 may include, respectively, one or more electrically conductive members or parts 34*a*-34*d* and 35*a*-35*d*, e.g., contacts, pins, wires, terminals, electrically conductive traces, etc. (any of which is used synonymously herein), that respectively connect to each other by physical engagement and, thus, provide electrically conductive connection when the male plug is plugged into the female housing. The female housing has an axis A and the male plug has an axis A' and the two axes align generally congruently, for example, when the male plug is inserted into the female housing.

Figure 5:
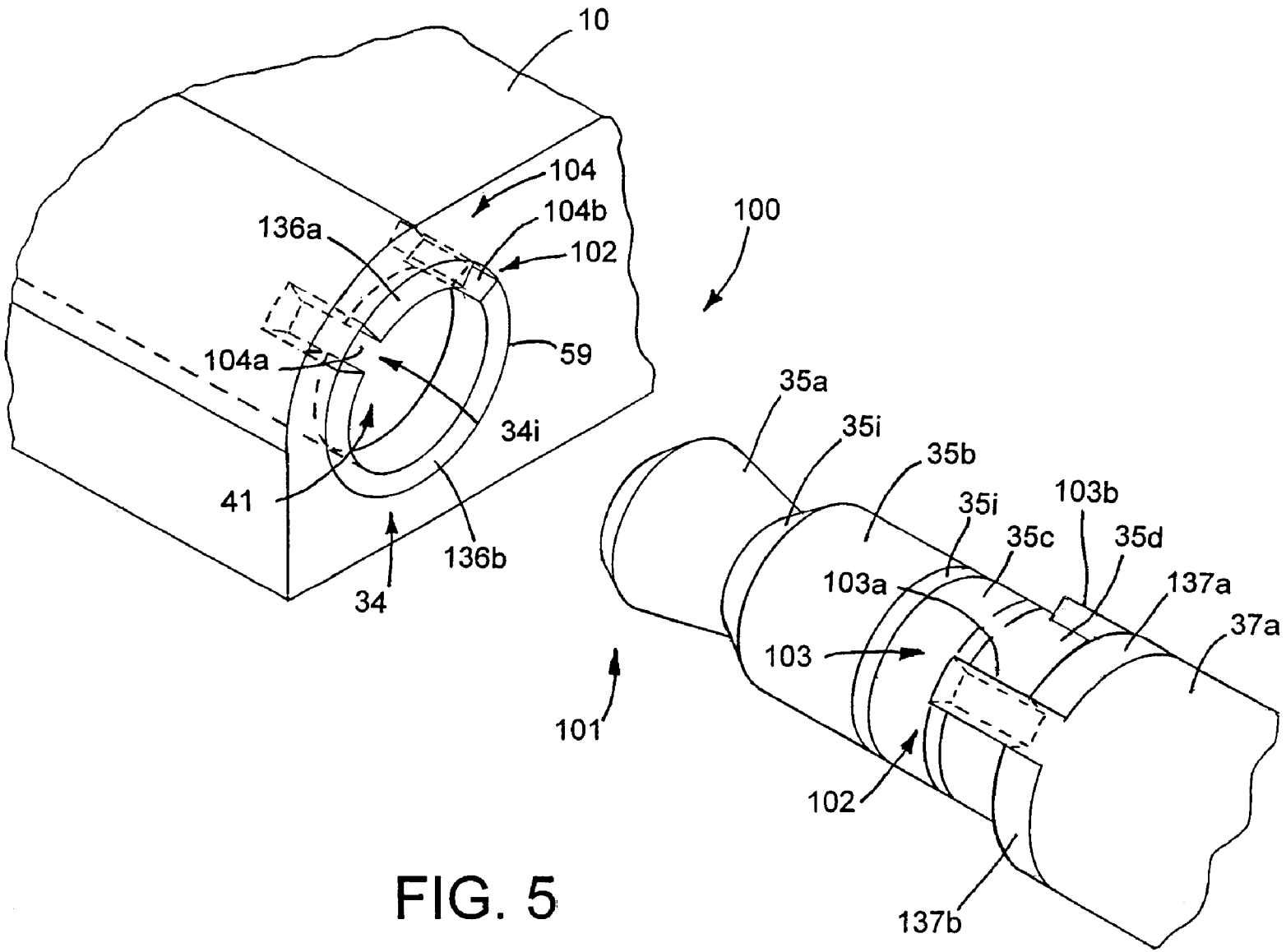
FIG. 5 is a schematic illustration of a connector system with an alignment feature and several infrared coupling portions.

The infrared coupling portion 33 of the connector system 1 includes infrared members 36, 37. The infrared members 36, 37 are oriented or positioned, respectively, relative to the female housing 34 and the male plug 35, e.g., in relation to respective axes A, A', so as generally to circumscribe the respective axes, e.g., as is illustrated in FIGS. 2A, 2B, 2C and 3, or partially to circumscribe the axes A, A', e.g., as is illustrated in FIG. 5. The infrared members 36, 37 may be otherwise positioned, e.g., relative to the axes A, A' or to the female housing 34 and plug 35, so that in operation with the plug 35 plugged into the female housing 34, suitable optical coupling is provided between respective infrared members to couple infrared signals therebetween.

Before continuing with the description of the infrared members 36, 37 and their use, it is noted that the form factor of the female housing 34 is like a standard receptacle for an audio jack, for example. Therefore, if a standard audio plug (audio jack) were plugged into the receptacle 34, electrically conductive connections between respective terminals of the receptacle and the audio plug may be achieved. Thus, although the receptacle 34 may be used with infrared coupling as well as electrically conductive connections to the inserted male plug 35, such receptacle is backwards compatible and may be used with other standard audio jacks that do not have the infrared capabilities described herein. Also, it will be appreciated that although examples herein may be directed to audio connection and audio jacks or connectors, etc., the invention may be used with other types of connections and connectors.

The infrared members 36, 37 may be an infrared source (also referred to as infrared emitter) and an infrared sensor (also referred to as infrared detector or receiver). An exemplary infrared source is a light emitting diode that produces infrared light output in response to a suitable input, e.g., an electrical signal. An exemplary infrared sensor may be a solid state device such as, for example, an infrared sensing diode. As an example, the type of infrared source and infrared sensor used in mobile phones, PDAs, etc. to "beam" or otherwise to couple information from one such electronic device to another may be used for the infrared members 36, 37. Other types of infrared sources and detectors may be used.

It will be appreciated from the illustrations and description that the electrically conductive portion 32 and infrared coupling portion 32, 33 of the connector part 2 are supported by the female housing 34, which in turn is supported by or is part of the case or housing 11 of the mobile phone 10, so as not to interfere with each other and so as to couple with the respective electrically conductive portion 32 and infrared coupling portion 33 of the other connector part 3, e.g., the male plug 35. The conductive and infrared portions of the male plug 35 also are supported by the male plug housing 37*a* or the like similarly, e.g., to provide coupling with the corresponding conductive and infrared members of the female connection part 2 without interference between electrical and infrared members. Accordingly, each respective connector part 2, 3 has its conductive and infrared portions supported or otherwise retained in generally fixed positional relation with respect to each other to avoid interfering with each other electrically or mechanically and to allow for electrical connection and infrared coupling with the conductive and infrared portions of the other connector part. Such retention in positional relation may be obtained by mounting or otherwise attaching or holding the respective infrared members and electric terminals on or with respect to the male plug 35 and the female housing 34.

Turning to FIG. 2, the female housing or opening 34 is shown with a male plug 35 inserted or plugged into the female housing 34. The female housing 34 has at least one electrical terminal (also referred to as electrical terminal portion)generally shown at 34*t* therein or exposed to the interior 34*i* thereof for engagement with and electrically conductive connection with a corresponding at least one electrical terminal (also referred to as electrical terminal portion) generally shown at 35*t* of the male plug 35. As is shown, the interior 34*i* of the female housing 34 extends generally linearly along axis A, and the electrical terminal 35*t* extends generally linearly along the axis A'. In using the connector parts 2, 3 of the connector system 1, the electrical terminal 35*t* may be inserted generally linearly along axis A into the female housing 34 to make respective electrical connections and to position the infrared members for optical coupling of infrared light.

In the several embodiments of FIGS. 2A-2D, the female housing 34 includes three electrical terminals 34*a*, 34*b*, 34*c*, 34*d* that are suitable electrically insulated or isolated from each other and are electrically connected by respective wires, circuit paths on a printed circuit board, etc., to the operating circuitry 24 of the mobile phone 10. Also, in the several embodiments of FIG. 2, the male plug 35 has three electrical terminals 35*a*, 35*b*, 35*c*, 35*d* and these are suitably electrically insulated or isolated from each other by electrically insulators 35*i*. Such arrangements of electrical terminals 34*a*-34*d* and 35*a*-35*d* may be the same or similar to those conventionally used in audio plugs for mobile phones, PDAs and the like or may be of some other type of design suitable for interconnection to provide for electrically conductive connection between terminals of the respective connector parts 2, 3, for example, or the like.

As is shown in FIGS. 1 and 2, the male plug 35 is plugged into the female housing 34, e.g., by insertion of the terminal portion 35*t* into the interior 34*i*, such that the respective pairs of electrically conductive members 34*a*-34*d* and 35*a*-35*d* are engaged and electrically connected for conduction. With the male plug 35 plugged into the female housing 34, the infrared members 36, 37 are positioned in relatively close proximity to each other to establish an infrared coupling therebetween. For example, electrical signals that are input or provided to the infrared emitter cause infrared output therefrom, e.g., a pulsing infrared light output representative of such input signals. The infrared light is sensed by the infrared detector, which may provide a corresponding pulsing electrical output by the infrared detector. Thus, signals from one infrared member are coupled to the other.

Connective paths 38*c*, 38*i*, e.g., wires, conductive traces on printed circuit boards, etc., from respective electrically conductive portions 32 and infrared coupling portion 33 are provided to the operating circuitry 24 of the mobile phone 10. Electrically conductive paths 39*c*, 39*i*, e.g., wires, conductive traces on printed circuit boards, etc., some of which may be within the inside or core of the male plug 35, are provided to the accessory, remote device, etc. 31 from the electrically conductive portion 32 and the infrared coupling portion 33. Thus, connection can be provided by the connector system 1 using both electrically conductive connection and infrared coupling techniques. Such connection and coupling using both conduction and infrared coupling may provide increased amount of signal transmission or bandwidth, etc. compared to using only electrical conduction with a limited or reduced number of electrical terminal connections.

In an exemplary embodiment the infrared members 36, 37 may receive electrical power from circuitry included in the operating circuitry 24 and/or operating circuitry in the accessory 31. For example, if the infrared member 36 were an infrared source or emitter, it may receive power from a connection to the operational control 40, and the power signal may be modulated according to the desired infrared light signal intended to be created by and output from the infrared source. Similarly, if the infrared member 37 were an infrared detector, it may be self-powered based on the received infrared light or it may receive electrical power from a power source in the accessory or via a connection provided by one of the electrically conductive connections provided by the connector system 1 from the operational control 40 or other portion of the operating circuitry 24.

In FIGS. 2A-2D, several embodiments illustrating exemplary arrangements of infrared members 36, 37 are shown.

In FIG. 2A the infrared member 36 is mounted in an extension 40 of the major extent of the case 11 outside of the entrance 41 to the interior 34*i* of the female housing 34 (also referred to as opening). The extension 40 may be an annular ridge, protuberance or protruding member that circumscribes the entrance 41 of the opening 34. The infrared member 37 is mounted in an end wall 42 of the male plug housing 37*a* in an annular groove or recess 43. The infrared members 36, 37 are so positioned as to face each other when the male plug 35 is plugged into the opening 34 so that there is line of sight coupling of infrared light from one of the infrared members to the other. Also, as is seen in FIG. 2A, the distance D between the two infrared members 36, 37 may be small, so that minimal (or no) infrared light escapes to the ambient environment to detrimentally affect other electronic devices or the like in the local area; and minimal (or no) infrared light from the ambient surroundings reaches the infrared members to degrade, e.g., by noise, the quality of infrared light signal coupling between the infrared members. Arrows 44 represent infrared light being emitted by the infrared member 36 and detected by the infrared member 37 to provide the infrared coupling between the infrared members. Infrared coupling could be in the reverse direction from infrared member 37 to infrared member 36. Two arrows 44 are illustrated, for example, to show that for one channel coupling the infrared light may be transmitted by one emitter about the annular infrared member 36 to the annular infrared member 37.

Referring both to FIGS. 2A and 3, the infrared members 36, 37 may be annular so as to circumscribe the respective axes A, A'. Such annular configuration may be provided, for example, using an annular infrared emitter and annular infrared detector. Such annular devices may be obtained using an annular infrared transmissive medium, such as, for example a solid polymer annular ring that conducts infrared energy therein. One or more infrared light emitting diodes associated with one of those rings may be positioned in or adjacent the ring to emit infrared light to be distributed substantially throughout the ring. One or more infrared detectors associated with the other ring may be positioned in or adjacent the other ring to detect infrared light therein that is received from the infrared light emitting diode(s). Other configurations of infrared members may be used, as desired. It will be appreciated that with the annular infrared members 36, 37 fully circumscribing the axes A, A', there will be infrared coupling of infrared signals between the infrared members 36, 37 without regard to the angular (or polar) orientation of the male plug 35 relative to the opening 34. Therefore, if the male plug 35 were rotated or twisted relative to the opening 34, there still would be good infrared coupling between the infrared members 36, 37. Coupling of infrared signals between the infrared members 36, 37 may be limited to signal transmission only in one direction, e.g., from the mobile phone 10 to an accessory 31 unless a means were provided to distinguish between signals transmitted in one direction or the other direction and appropriate electric signal channels would be provided for energizing respective infrared emitters and for detecting infrared light from respective infrared detectors.

In FIG. 3 which is taken from FIG. 2A looking in the direction of the arrows 3-3, respective diameters and circumferences of respective parts of the connectors system 10 are illustrated. At 50 is a representation of the outside diameter of the male plug housing 37*a* and also the outside diameter of the protruding extension 40 in which the infrared member 36 is contained. At 51 is the outside diameter of the infrared member 37 contained in the end wall 42 of the male plug housing 37*a*. At 52 and 53 are, respectively, the outer and inner diameters of the infrared member 36. At 54 is the inside diameter of the male plug infrared member 37. At 55 is the inside diameter of the entrance 51 to the opening 34. At 56 is the outer diameter of the electrical terminal 35 of the male plug 35.

As is seen in FIGS. 2A and 3, the annular width of the infrared member 36 is less than the annular width of the infrared member 37. As an example, the infrared member 36 may be the infrared emitter and the infrared member 37 may be the infrared detector that receives infrared light from the infrared member 36. A relatively wider annular width infrared member 37 may be able to receive and to detect relatively maximum amount of infrared light emitted by the infrared member 36 in case some of that emitted infrared light is directed other than parallel to the axes A, A'. Also, by making the parts of the connector system 1 such that the dimension D is relatively small between the end wall 42 and the infrared member 37, on the one hand, and the extension 40 and infrared member 36, on the other hand, the amount of infrared light from the ambient surroundings 57 that might reach the infrared member 37 and be detected so as to degrade the intended infrared signal detected from the infrared member 36 would tend to be minimized. Therefore, good coupling of infrared light between the infrared members 36, 37 would be achieved with relatively low noise affecting the signal from ambient infrared sources. Furthermore, if desired suitable shielding may be provided to block infrared light from ambient infrared sources from reaching the infrared detector, e.g., infrared member 37. It will be appreciated that although coupling of infrared signals from the infrared member 36 to the infrared member 37 is described above, such coupling may be in the opposite direction from the infrared member 37 to the infrared member 36.

Summarizing, the invention provides for transmitting data between an accessory 31 and an electronic device 10, e.g., portable electronic equipment, such as a mobile phone, via an electrical connector system 1, for example, a connector that is similar in size and shape to an audio connector or audio jack or audio plug 35 and a receptacle 34. The approach may be used with conventional audio jacks or connectors and/or with other connectors whether or not of the audio type. The approach may be used with a 3.5 millimeter audio jack that may provide for fewer electrically conductive connections than other audio jacks. Infrared energy coupling is used to transmit data between the audio jack (e.g., the female housing part of the connector system mentioned above) and the male plug or in the opposite direction. By changing the current (or voltage, depending on the nature of the infrared emitter, e.g., whether it emits infrared light based on current or voltage) in the infrared energy emitter, e.g., infrared member 36 or 37, there will be an infrared signal produced thereby and detected by the infrared detector, e.g., the other infrared member 36, 37. This infrared coupled signal may be used to transmit signals, e.g., signals that represent data or something else.

Exemplary accessories may be headsets, mono or stereo headphones, external amplifier(s) and/or speaker(s), etc. Other types of accessories may be used with the connector system 1 and mobile phone 10 to receive outputs from the connector and/or to provide inputs to the connector.

Briefly referring to FIG. 2B, a connector system 1' is illustrated. The connector system 1' is similar to the connector system 1 except the infrared member 36 is located in the housing wall 58 of the case 11 of the mobile phone 10. For example, the infrared member may be in an annular groove 59 in the housing wall 58. The connector system 1' of FIG. 2B does not necessarily require the extension 40 of the connector system 1 of FIG. 2A.

Briefly referring to FIG. 2C, a connector system 1" is illustrated. The connectors system 1" is similar to the connector systems 1 and 1" except the infrared member 36 is within the interior 34*i* of the female housing or opening 34, and the infrared member 37 is mounted about a portion of the male plug 35 that in use is located with the interior 34*i*. Such arrangement of infrared members helps to avoid the possibility of leakage of infrared light from the infrared emitter to the ambient environment and also tends to block infiltration of ambient infrared light to the infrared detector.

Briefly referring to FIG. 2D, a connector system 1''' is illustrated. The connector system 1''' is similar to the connector systems 1, 1' and 1" except the infrared member 36 is mounted in the housing 34 at the inside end 34*e* of the interior 34*i*, and the infrared member 37 is mounted in the leading tip or edge 35*e* of the electrical terminal 35*t* of the male plug 35. Such arrangement allows for quite an isolated environment for infrared signal transmission between the infrared members 36, 37. Additionally, as illustrated in FIG. 2D, infrared members 36', 37' are similar to the infrared members 36, 37 of the FIG. 2C embodiment and also may be used to couple infrared signals. The arrangement of duplicate infrared member pairs 36, 37 and 36', 37' allows for two sets of infrared signal coupling capability for the connector system 1''', e.g., on separate channels.

Figure 4:
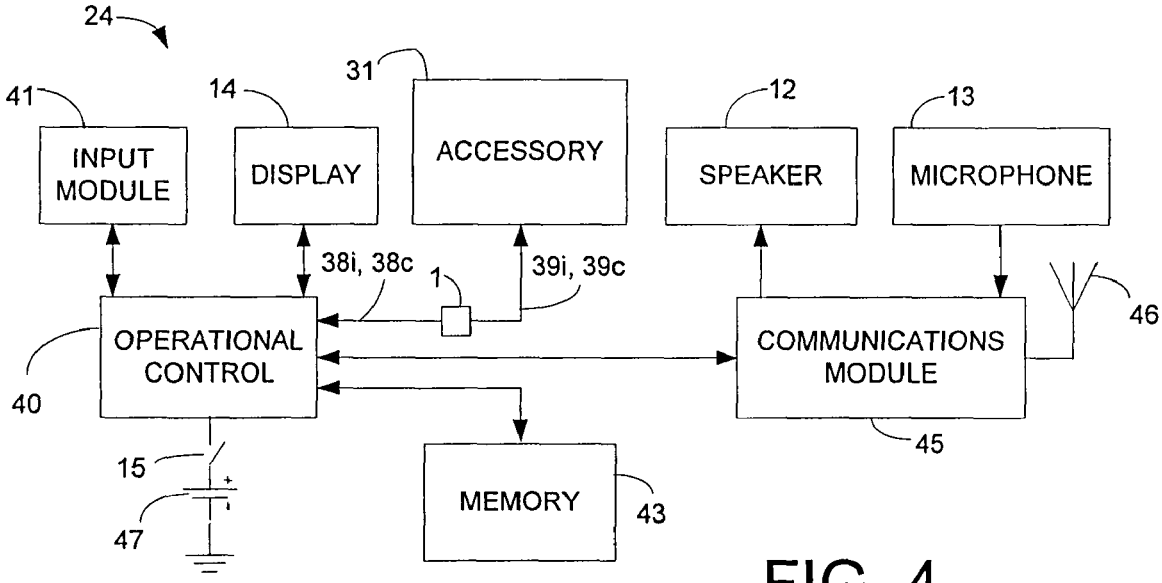
FIG. 4 is a schematic block system diagram of circuitry of the mobile phone of FIG. 1A.

Turning to FIG. 4, a schematic block system diagram of operating circuitry 24 of the mobile phone 10 is illustrated. The illustration is exemplary; other types of circuitry may be employed in addition to or instead of the operating circuitry 24 to carry out the various functions of a mobile phone and the various functions described in detail herein. The operating circuitry includes an operational control 60 that controls the various components of the operating circuitry 24. An input module 61 provides inputs to the operational control 60, such as, for example, inputs from the various keys 16. Inputs also may be provided from the display 14 if it is a touch screen type of display, and inputs also may be provided the input module 61 from other connections to the mobile phone, etc. The display 14 may be a touch screen that provides for inputs to the input module 61 by touching using a finger, a stylus, or some other device, and the result of such touching may be provided as inputs to the operational control 60. The operational control 60 also may operate the display 14 to determine what information, icons, images, etc. is shown on the display 14.

The accessory 31 is coupled to the operating circuitry via the connector system 1. More particularly, the accessory 31 is connected to the operational control 60 of the operating circuitry and operates in response to the operational control 60 and/or in response to receiving other suitable input. The accessory 31 also may provide input to the operating circuitry via the connector system 1.

Electrical power may be provided by the operational control 60 to the accessory 31. Program code in the operating circuitry 24, e.g., stored in the memory 63, may control operation of the operational control 60 to operate the accessory 31. Circuitry in and/or programming in the operating circuitry 24 and/or operational control 60 may determine various operational features of the mobile phone 10 and/or the accessory 31.

As an example, the operational control 60 may be a microprocessor or some other electrical or electronic device that is responsive to various inputs, e.g., input signals, and provides various outputs, e.g., output signals. The operational control 60 may be internally programmed or manufactured in a way to include internal programming thereof to carry out various functions. However, in many instances an operational control 60 of a mobile phone 10 would have associated therewith the memory 63 in which appropriate programming instructions, computer program, logic, etc., may be provided the operational control 60 to carry out the functions thereof. The memory may include identity information concerning respective accessories and settings of the operating circuitry in response to respective identity information. The memory 63 also may include storage for telephone numbers and other information concerning contacts who may be called, messaged, etc. using the mobile phone 10, storage of photographs and/or other data, as often is the capability of such memory in conventional mobile phones, for example, and the memory may be used for other purposes that may come into existence in the future. The memory 63 may be a read only memory, random access memory (RAM), flash RAM, programmable read only memory, or some other memory device. Also associated with the operational control 60 is a timer 64 that can be used to provide timing signals representing increments of time for synchronizing operation of the operating circuitry 24 with some other device, for clock/calendar control functions, and/or for determining amount of time (duration) for the hold on function and/or for a screensaver function.

The operating circuitry 24 also includes a communications module 65 that receives inputs from microphone 13 and provides outputs to the speaker 12, as are common functions in a mobile phone. An antenna 66 may be coupled to the communications module 65 to transmit and to receive signals representing telephone communications, data communications, messages, etc. The communications module 65 may operate under control of the operational control 60 in the usual manner of a mobile phone. Additionally, the communications module 65 may provide an input to the operational control 60 to indicate that there is an incoming telephone call or text message; and in response thereto, the operational control 60 may operate the display 14 in conventional manner, e.g., to indicate an incoming phone call, to show a text message or photograph, etc.

A power supply 67 provides electrical power to the operating circuitry 24 and/or to other parts of the mobile phone 10 via the on/off switch 15. The power supply may be a conventional battery or some other source of electrical power. Upon closing the on/off switch 15, the power is provided the operating circuitry 24 to carry out the various functions described herein, for example. If desired, closing the switch 15 may lead to temporary operation of the display to display a start-up message or indication, and then a power saving feature, e.g., a screensaver function, may be implemented to turn off the display.

Operation of the mobile phone 10 may be under computer program control or the like. Such operation may be as is performed to carry out the functions of a mobile phone. Operation of the accessory 31 may be carried out under computer program control or the like. Such operation also may be as is performed in a conventional manner. The computer programs and computer program control may be carried out by persons who have ordinary skill in the art to prepare and to use such programs and control. New computer program control techniques and methods also may be developed in the future by persons having ordinary skill in the art and may be used in connection with the connector system and mobile phone and accessories.

Referring to FIG. 5, a connector system 100 according to an embodiment of the invention includes plural infrared emitters and plural infrared detectors and an alignment feature 101 to guide the male plug 35 into the female housing 34 in an orientation such that the respective infrared members 136*a*, 137*a* and infrared members 136*b*, 137*b* are in paired alignment for coupling respective signals. In the illustrated embodiment paired alignment is achieved using a spline or spline-like connection 102 between the male plug 35 and the female housing 34. For example, the male part 103 of the spline 102 is provided by male protrusions 103*a*, 103*b* on the male plug housing 37*a*. The female part of 104 of the spline 102 is provided by female recesses or slots 104*a*, 104*b* that are formed in the female housing 34 at the entrance 41 to the interior 34*i* of the female housing. As the male plug 35 is inserted into the female housing 34, the male protrusions 103*a*, 103*b* slide into the slots 104*a*, 104*b*. The arrangement of protrusions 103*a*, 103*b* and slots 104*a*, 104*b* is such that the male plug 35 ordinarily would not be fully insertable into the female housing unless proper alignment was had with the protrusions located in the slots.

The infrared members 136*a*, 136*b*, 137*a*, 137*b* may be the same as or similar to the infrared members 36, 37 described above. However, in the embodiment of FIG. 5, the infrared there are two infrared members on the female housing 34 and these are separated, e.g., optically separated, insulated or blocked from light transmission between them, by the slots 104*a*, 104*b* and/or by the protrusions 103*a*, 103*b* when such protrusions are inserted in the slots. Thus, the material of which the protrusions 103*a*, 103*b* is made does not conduct infrared light thereby to provide such light blocking effect, or, alternatively, some other light blocking material on the protrusions 103*a*, 103*b* may be used to block infrared light transmission between the infrared members 136*a*, 136*b*. Similarly, on the male plug 35 the protrusions 103*a*, 103*b* separate the infrared members 137*a*, 137*b* or other appropriate shielding or light blocking is provided so that infrared light from or incident on one infrared member does not impinge on or affect the other infrared member.

The infrared members pairs 136*a*, 137*a* and pairs 136*b*, 137*b* are mounted on the respective male plug 35 and female housing 34 so as to be in paired alignment so that infrared light can be transmitted and received by respective pairs. Thus, for example, the infrared members 136*a*, 136*b* may both be infrared emitters that emit infrared light to be detected, respectively, by the infrared detectors 137*a*, 137*b*. Alternatively, both infrared members 137*a*, 137*b* may be infrared emitters and both infrared members 136*a*, 136*b* may be infrared detectors. In either of these two cases the infrared members provide for two separate channels over which signals can be coupled in the same direction, e.g., from either the female housing 34 to the male plug 35 or vice versa by infrared light emission and detection. Alternatively, if desired, the infrared member 136*a* may be an infrared emitter and the infrared member 137*a* may be an infrared detector; and the infrared member 137*b* may be an infrared emitter and the infrared member 136*b* may be an infrared detector. In this case signals can be transmitted by infrared coupling in one direction by one of the infrared member pairs 136*a*, 137*a* and signals may be coupled in the other direction by the other infrared member pairs 137*b*, 136*b*.

It will be appreciated that although two pairs of infrared members are illustrated in FIG. 5, there may be more than two pairs. Appropriate alignment features 101, 102, etc. may be used to separate respective pairs in the manner described above, for example, using the protrusions 103*a*, 103*b* in slots 104*a*, 104*b*; or, if desired other light blocking materials or arrangements may be used to separate infrared light in one channel provide by one pair of infrared members from infrared light in one or more other channels.

In using the connector system 100, the mail plug 35 may be inserted into the entrance 41 to the interior 34*i* of the female housing so that the respective terminals 35*a*, 35*b*, 35*c*, 35*d* engage and connect by electrical conduction with respective terminals 34*a*, 34*b*, 34*c*, 34*d* in the female housing 34, as is illustrated in FIGS. 2A-2D and is described above. Thus, electrical connection by such conduction is provided for respective circuits between the mobile phone 10 and the accessory 31; and further signals can be coupled in either or both directions by infrared coupling using the infrared members 136*a*, 136*b*, 137*a*, 137*b*; thus, signals can be transferred between the mobile phone 10 and accessory 31.

In some places, e.g., in some countries or other jurisdictions, there are discussions about having a 4 pin connector or jack, e.g., 3.5 mm (millimeter) audio jack and UBS on mobile phones as standard connectors. Such connectors have limited and standardized pins, which limit the ability to communicate between the mobile phone (also referred to as mobile equipment (ME)) and accessories while still keeping to the new connector form factor and standard. Summarizing, the invention is directed, for example, to data communication between one or more accessories and the mobile equipment using the electrically conductive connections provided by the connector and also using infrared coupling, for example, surrounding the connector.

In an exemplary embodiment directed to a 3.5 mm connector, surrounding the 3.5 mm connector is a light guide for infrared (also abbreviated "IR") data transmission. In accordance with such embodiment, a normal IR communication channel is combined with a standard connector to make "smarter" accessories, for example, by providing the ability to provide additional communication with such accessories. When an accessory is connected to the mobile equipment, e.g., the jack is plugged into a receptacle (such as a female connector housing or opening, in the mobile equipment, the IR signals initially attempt to establish a data transfer mode and to establish a data communication channel. If the accessory is unknown, e.g., is an accessory that is not manufactured by the manufacturer of the mobile equipment or is not compatible with the mobile equipment, the IR communication is shut down and the connector works according to the standard for such connectors that do not have the IR communication capability. The IR communication could be used for both data communication and identification of the accessory, for example, with a simple repeat of the sent IR data. When the IR is received in the accessory the IR data may be reflected back to the mobile equipment to identify the type of accessory connected.

Figure 6:
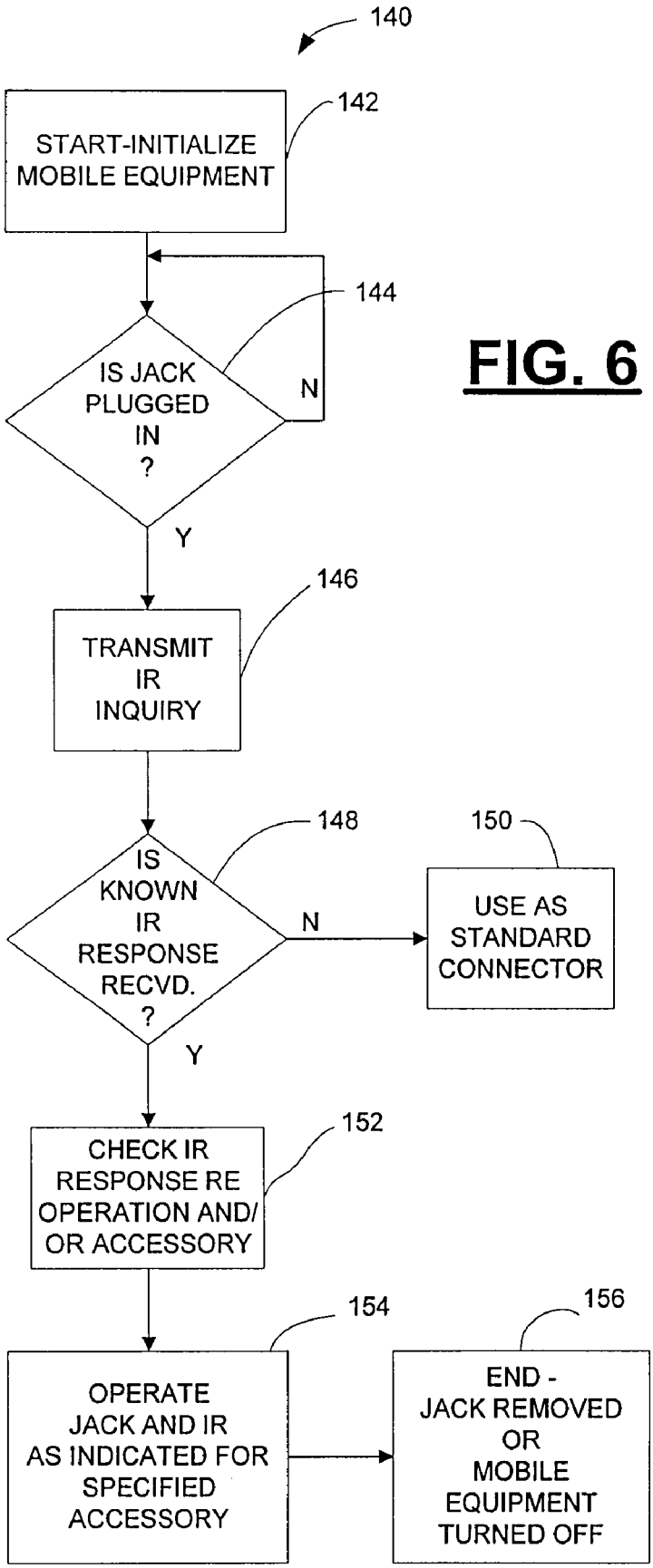
FIG. 6 is a functional block diagram illustrating an example of operation of a connector system embodying some features of the invention.

Briefly referring to FIG. 6, an exemplary block diagram, also referred to as a logic diagram, routine or flow chart, is illustrated at 140. The logic diagram includes a number of steps that represent an example of operation of the various connector systems 1, 100, etc. describe herein. Other operational examples also are possible. The several steps that are illustrated and described in FIG. 6 may be carried out using computer program software or the like that may be provided the mobile phone 10 and/or the accessory 31. Such software may be written in an appropriate computer language or code by a person who has ordinary skill in the art based on the disclosure herein. The functions illustrated in the logic diagram 140 that are described below may be carried out by the operating circuitry 24. The program code may be stored in the memory 43.

In the logic diagram 140, at block 142 is start and/or initialization. This may represent a turning on of the mobile phone 10, for example. At block 144 an inquiry is made whether a connector, audio jack, etc., e.g., male plug 35, is plugged in to the mobile phone, e.g., at the female housing 34. If the answer is no, then loop line is 146 is followed. If the answer is yes, then at block 148 the an infrared signal is transmitted, e.g., from the infrared member 36 to the infrared member 37 (FIG. 2A), to inquire what is the nature of the connector that is plugged in to the mobile phone and if there is an infrared capability of the connector (male plug 35) what is the nature of that connector and/or the accessory 31 attached thereto?

At block 150 an inquiry is made whether a known response is received back by the mobile phone IO as a result of the inquiry at block 148. If the response received is unrecognized, e.g., due to the fact that the accessory 31 is unrecognized or due to the fact that there is actually no response because the plugged in jack (connector) does not have infrared capability, then at block 152 the jack 35, for example, and the accessory are operated in a normal manner without any infrared communication channel between the mobile phone 10 and the accessory 31.

If at block 150 there is a received response that can be identified, then at block 154 the nature of that response is checked to determine details about the response. For example, if the returned signal or response may be checked against a lookup table to determine what accessory corresponds with the particular response that was received. By determining which accessory, for example, returned the response, the mobile phone 10 then may operate that accessory in an optimum way according to the capabilities and functions of the accessory. Such operation then is carried out at block 154.

At block 156 the logic or flow chart ends. For example, if the mobile phone were turned off or the jack 35 were pulled from the female housing 34, the routine 140 would end. The routine 140 could be restarted at block 142 again, for example, upon turning on the phone and/or plugging in the jack 35 again, etc.

Several exemplary advantages may be obtained using the invention. For example, as is described herein, the physical placement of the IR mechanism with respect to a standard electrical connector makes for unique combination and usage possibilities of two technologies, namely, electrically conductive connection and infrared coupling and data transmission. Also, it is possible to use the two technologies separately or in combination and in the latter case to have extended functionality. With the placement of the infrared members close to the connector, only relatively simple components without extreme size and positional precision is needed since the infrared coupling and communication only is used for short range communication. Furthermore, full compatibility to standard connectors and data channel for transferring data like key presses, song titles, etc. between the mobile equipment and the accessory is possible.

Also, it will be appreciated that in the various embodiments described herein, the developing, generating, producing, etc. of infrared light and use thereof to represent signals as well as the detecting of those infrared light and signals may be carried out using apparatus of the type used for "beaming" information, games, etc., between portable electronic devices, such as mobile phones, PDAs, etc., as was mentioned above. It will be appreciated that the invention provides both electrically conductive connection and infrared coupling type connection for such signals and the like.

It will be appreciated that portions of the present invention can be implemented in hardware, software, firmware, or a combination thereof. In the described embodiment(s), a number of the steps or methods may be implemented in software or firmware that is stored in a memory and that is executed by a suitable instruction execution system. If implemented in hardware, for example, as in an alternative embodiment, implementation may be with any or a combination of the following technologies, which are all well known in the art: discrete logic circuit(s) having logic gates for implementing logic functions upon data signals, application specific integrated circuit(s) (ASIC) having appropriate combinational logic gates, programmable gate array(s) (PGA), field programmable gate array(s) (FPGA), etc.

Any process or method descriptions or blocks in flow charts may be understood as representing modules, segments, or portions of code which include one or more executable instructions for implementing specific logical functions or steps in the process, and alternate implementations are included within the scope of the preferred embodiment of the present invention in which functions may be executed out of order from that shown or discussed, including substantially concurrently or in reverse order, depending on the functionality involved, as would be understood by those reasonably skilled in the art of the present invention.

The logic and/or steps represented in the flow diagrams of the drawings, which, for example, may be considered an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The above description and accompanying drawings depict the various features of the invention. It will be appreciated that the appropriate computer code could be prepared by a person who has ordinary skill in the art to carry out the various steps and procedures described above and illustrated in the drawings. It also will be appreciated that the various terminals, computers, servers, networks and the like described above may be virtually any type and that the computer code may be prepared to carry out the invention using such apparatus in accordance with the disclosure hereof.

Specific embodiments of an invention are disclosed herein. One of ordinary skill in the art will readily recognize that the invention may have other applications in other environments. In fact, many embodiments and implementations are possible. The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

I claim:

1. A connector for use in providing both electrically conductive connection and infrared connection, comprising at least one electrically conductive member adapted to provide electrically conductive connection to a further electrically conductive member, the at least one electrically conductive member having a linear axial extent and including at least one electrical terminal along the axial extent, an infrared member adapted for use in infrared coupling with a further infrared member, the infrared member comprising at least one of an infrared source or infrared sensor supported in relation to the at least one electrical terminal in at least partial circumscribing relation about the axial extent, the at least one electrically conductive member and the infrared member being held in positional relation to each other to be positioned with respect to a further connector for electrically conductive connection and infrared coupling with respect thereto, the further connector comprising at least a one further electrically conductive member adapted to connect by electrical conduction with the at least one electrically conductive member, and a further infrared member adapted to connect by infrared to the infrared member, and an alignment guide adapted to guide connection of the connector and further connector to provide alignment of the infrared member and further infrared member.

2. The connector and further connector of claim 1, comprising a connector system wherein one of the infrared member and further infrared member comprises an infrared source and the other of the infrared member and further infrared member comprises an infrared sensor, the infrared source and infrared sensor adapted to transmit and to receive, respectively, signals therebetween.

3. The connector of claim 1, said at least one electrically conductive member comprising a male plug having a support structure adapted to support the electrical terminal, and wherein the infrared source or infrared sensor is supported at least in proximity to the at least one electrical terminal.

4. The connector of claim 3, wherein the infrared member is in the at least one electrical terminal of the male plug.

5. The connector of claim 4, wherein the infrared member is at or in proximity to the leading tip of the at least one electrical terminal of the male plug.

6. The connector of claim 1, further comprising a housing, an opening in the housing, the at least one electrically conductive member in the opening in position to provide electrically conductive connection to a further electrically conductive member that may be inserted in the opening, and wherein the infrared member is supported with respect to the opening for optical coupling with a further infrared member when such another electrically conductive member is inserted in the opening.

7. The connector of claim 6, wherein the infrared member is within the housing accessible to the interior of the opening and adapted at least one of to send infrared light into or to receive infrared light from within the opening.

8. The connector of claim 6, wherein the infrared member is mounted outside the housing and opening.

9. The connector of claim 1, wherein the infrared member comprises a plurality of infrared members.

10. The connector of claim 1, wherein the at least one electrically conductive member comprises an audio connector, and the infrared member is attached to the audio connector for support thereby.

11. A portable electronic device comprising the connector of claim 1.

12. The portable electronic device of claim 11, comprising a mobile phone.

13. The connector system of claim 2, wherein the further connector comprises a housing, an opening in the housing and adapted to receive at least part of the at least one electrically conductive member inserted in the opening for electrically conductive connection between the at least one electrically conductive member and the further electrically conductive member, and wherein the infrared member and the further infrared member are positioned in relation to the respective at least one electrically conductive member and the further electrically conductive member to be in optically coupled relation when the at least one electrically conductive member is in the opening in electrically conductive connection with the further electrically conductive member.

14. The connector system of claim 13, said infrared member comprising a plurality of infrared members, said further infrared member comprising a plurality of infrared members, said infrared members and further infrared members being respectively supported for paired alignment to provide communication between respective pairs of infrared sources and infrared sensors, an said alignment guide adapted to guide connection of the connector and further connector to provide paired alignment of respective pairs of infrared sources and infrared sensors to obtain respective separate communication channels between respective pairs of infrared source and infrared sensor.

15. The connector system of claim 2, wherein with the electrical connector and further electrical connector connected, the infrared member and further infrared member are positioned in close proximity and cooperative relation to block leakage of infrared energy away from the connected connector and further connector.

16. A portable electronic device, comprising the connector system of claim 2, and comprising a housing, the further connector comprising an audio connector for the portable electronic device, and the connector comprising an audio plug adapted for coupling to an accessory of the portable electronic device.

17. The portable electronic device of claim 16, comprising a mobile phone.

18. A method of connecting electrical signals, comprising using a pair of electrical connectors, each having an electrically conductive connection portion and an infrared connection portion, one of the infrared connection portions including an infrared energy source and the other infrared connection portion comprising an infrared energy detector, providing both electrically conductive connection between respective electrically conductive connection portions and infrared energy coupling between respective infrared energy source and infrared energy detector, thereby to provide transfer of signals between the connectors via electrical connection channel and an infrared energy coupling channel, wherein at least one of the electrically conductive connection portions has a linear axial extent and includes at least one electrical terminal along the axial extent, and at least one of the infrared connection portions is supported in relation to the at least one electrical terminal in at least partial circumscribing relation about the axial extent, and wherein the linear axial extent includes an alignment guide adapted to guide connection of the pair of electrical connectors to provide alignment of the infrared energy source and infrared energy detector.

* * * * *